US006199345B1

(12) United States Patent
Dean

(10) Patent No.: US 6,199,345 B1
(45) Date of Patent: Mar. 13, 2001

(54) METHOD AND APPARATUS FOR SEISMICALLY RETROFITTING A HOUSEHOLD CHIMNEY

(76) Inventor: Gary A. Dean, 37 Avondale Ave., Redwood City, CA (US) 94062

( * ) Notice: Subject to any disclaimer, the term of this patent is extended or adjusted under 35 U.S.C. 154(b) by 0 days.

(21) Appl. No.: 08/534,544

(22) Filed: Sep. 27, 1995

(51) Int. Cl.[7] ..... E04H 12/18

(52) U.S. Cl. ..... 52/745.17; 52/218; 52/219; 52/745.21

(58) Field of Search ..... 52/218, 219, 301, 52/244, 503, 439, 723.1, 736.3, 745.17, 745.21

(56) References Cited

U.S. PATENT DOCUMENTS

| | | |
|---|---|---|
| D. 285,045 | 8/1986 | Mahoney . |
| D. 285,411 | 9/1986 | Mahoney . |
| 3,602,468 | 8/1971 | Stone . |
| 4,173,923 | 11/1979 | Snook . |
| 4,190,993 | 3/1980 | Pohlman et al. . |
| 4,519,303 | 5/1985 | Snook . |
| 4,567,700 | 2/1986 | Snook . |
| 4,686,807 | 8/1987 | Newsome . |
| 4,731,967 | 3/1988 | Mclauglin . |
| 4,963,191 | 10/1990 | LaFleur . |
| 5,291,706 | 3/1994 | Beardsley et al. . |
| 5,362,224 | 11/1994 | Hasti et al. . |

OTHER PUBLICATIONS

"1991 Uniform Building Code", International Conference of Building Officials, pp. 147–148 158–159, 168–169, 184–186, 190, 194, 253, 655–669.

"National Design Specification for Wood Construction", 1991 Edition, National Forest Products Association, Table 8.2B.

"Reinforced Concrete Design Handbook", Second Edition, 1955, Table 1.

"Design of Earthquake–Resistant Buildings", Minoru Wakabayashi, 1986, pp. 178–183.

"Earthquakes, An Architect's Guide to Nonstructural Seismic Hazards", Henry J. Lagorio, 1990, pp. 148, 165–169, 300.

Ahrens Chimney Technique, Installation Process Brochure, 2 pages, 1992.

*Primary Examiner*—Richard Chilcot
(74) *Attorney, Agent, or Firm*—William E. Alford

(57) ABSTRACT

A method and apparatus for seismically retrofitting pre-existing household brick chimneys is described to meet current building codes. Vertical steel rebar and horizontal chimney anchors are inserted into the chimney and a polymer concrete is poured between the liner and the brick masonry thereby bonding to the chimney, the vertical steel rebar, and the horizontal chimney anchors. The horizontal chimney anchors are coupled at one end to the external face of the chimney and at another end to the interior frame of the house. Holes are vertically drilled into the masonry of the chimney base in order to anchor the steel rebar at one end. Holes are drilled through the chimney and into the interior of the house at an appropriate point to properly anchor the pre-existing chimney to the house. A polymer concrete that has similar heat properties to other fireplace components is poured into the chimney around a chimney liner in order to reinforce and provide resiliency.

4 Claims, 13 Drawing Sheets

METHOD AND APPARATUS FOR SEISMICALLY RETROFITTING A HOUSEHOLD CHIMNEY

FIELD OF THE INVENTION

This invention relates generally to a chimney. More particularly, the invention relates to seismic upgrades of pre-existing household chimneys in order to meet earthquake standards.

BACKGROUND OF THE INVENTION

In older existing homes built in areas prone to earthquakes, brick chimneys may crack or be completely destroyed during an earthquake. If a brick chimney is significantly damaged during an earthquake it may cause bricks to fall to the ground possibly injuring persons or property nearby. To avoid this in certain cities and counties, earthquake standards for new chimney construction have been introduced. The Uniform Building Code sets minimum standards while cities may impose higher standards for new chimney construction. Furthermore certain cities have required that preexisting chimneys be brought up to code when any work is to be performed upon the masonry unit of a chimney or fireplace. Also, real estate sales contracts were written which required a seller to repair the fire, safety, and structural defects of older pre-existing chimneys upon the transfer of title to a home. Previously to meet building codes it required the removal of all or portions of the old chimney and then construction of a new chimney that would meet the building codes.

In older homes and geographic areas without earthquakes, chimneys may be non-reinforced. FIG. 1A represents a cutaway view of a non-reinforced chimney 112A resting upon a fireplace 110. The outer facade of the fireplace 110 and chimney 112, also referred to as the brick masonry unit 128, is made up of brick 160 and mortar 162. Within chimney 112A there is an airspace 103 and a chimney liner 104. Many older homes may not have the chimney liner 104 and rely on the brick masonry unit 128 to direct heat and smoke up through the chimney and out into the atmosphere.

Chimneys may be designed into a home in three broad categorical groupings. One group of chimneys may be designed and constructed such that the fireplace and chimney are external to a home and the back face of the chimney adjoins a homes wall for a significant portion of the chimney height. This first group will be referred to as "external wall chimney". A second group of chimneys may designed and constructed such that the fireplace and chimney are external to a home and the chimney is freestanding above the roof-line for a significant portion of the chimney height. This second group will be referred to as "external roof chimney". A third group of chimneys may be designed and constructed such that the fireplace is completely internal to the home and the chimney only rises above the roof for a short portion of the chimney. This third group of chimneys will be referred to as "internal chimneys". The construction codes for a given city will vary depending upon the above type of chimney that is designed and constructed in a home. For example, pre-existing internal chimneys require no horizontal reinforcement or anchorage because there is little danger that an internal chimney will fall on persons or property.

As earthquakes caused damage to chimneys in geographic areas prone to earthquakes, real estate sales contracts were written which required a seller to repair the fire, safety, and structural defects of older pre-existing chimneys upon the transfer of title to a home. Initially only a horizontal tie or anchorage at the roof-line or plating was installed. FIG. 1B represents early attempts to satisfy the horizontal reinforcement requirements for pre-existing external wall chimneys that were flush to a house wall. In FIG. 1B, chimney 112B has an external strap 120 attached to an external wall 125 by use of bolts 121. This is similar to a brace illustrated in U.S. Pat. No. Des. 285,411 invented by Nathaniel J. Mahoney having a filing date of Nov. 30, 1983. One disadvantage to the use of the external strap 120 is that chimney 112B may break or crack just above the external strap 120. Another disadvantage to the use of the external strap 120 is that the bolts 121 may break free from the wall 125 because of the pulling force exerted by the weight of the chimney is so large that the wall can not bear it. Generally the bolts 121 are inserted into holes in the wall 125 that have been drilled through cement. Another disadvantage to the use of the external strap 120 is that it does not satisfy the Uniform Building Code requirements for horizontal reinforcement and anchorage of preexisting chimneys. It is desirable that an external strap or anchor for a preexisting chimney be bolted to the internal frame of a house and meet current building code requirements.

As stronger earthquakes occurred, it became known that a horizontal anchorage such as illustrated by FIG. 1B was not enough to prevent parts of a chimney from falling in the case of the external wall or external roof chimney types. Vertical reinforcement was introduced into the pre-existing chimney. FIG. 1C illustrates an early attempt at providing the vertical reinforcement of a preexisting chimney in order to meet these initial codes. Chimney 112C rests upon a fireplace 110. A mortar cap 114 completes the top of the chimney 112C while a spark arrestor 116 is attached to either a chimney liner 104 or the mortar cap 114.

In order to reinforce the chimney and meet the initial codes, the mortar cap 114 was removed and a hole 106 was drilled into the mortar of the firebox at each corner of the chimney. A mortar cement 105 was placed in each hole 106 and steel rebar 100 of one-half inch or five-eights inch diameter extending the length of the chimney 112C was inserted into each hole 106. A mortar cement 102 was poured into the void between the brick chimney and the chimney liner 104 to further solidify the chimney. To reinforce the mortar cap, a bond beam 108 of two wraps of a No. 2 pencil steel rod was placed around the four steel rebars 100. While this technique met the earlier code for vertical reinforcement of pre-existing chimneys it did little to meet the horizontal reinforcement and anchorage required by newer codes. Also the use of cement as a filler added extra weight to a chimney such that foundations were unable to support it.

The 1991 Uniform Building Code for new home and new chimney construction in earthquake prone zones, such as seismic zone 4, require a chimney to be affixed to a house's frame in order that a chimney does not fall away from the house during an earthquake. FIG. 2A illustrates the use of a mason's anchor strap 220 that is attached to a wooden beam 221 by nut/bolt assemblies 222 and 223 that satisfies the 1991 Uniform Building Code seismic anchorage requirement for new chimney construction. The mason's anchor strap 220 is inserted into the chimney while it is being constructed. The wooden beam 221 is attached to the homes joists and the mason's anchor strap 220 is attached to the wooden beam 221 during the homes construction. Horizontal reinforcement in newly constructed chimneys is provided by horizontal reinforcing ties 208A–N at eighteen inch intervals using a minimum of one quarter inch diameter steel such as a number two pencil rod that horizontally ties the vertical steel rebars 100 together.

FIG. 2B illustrates a new mason's anchor strap 220 with the nut/bolt assemblies 222 and 223. The mason's anchor strap 220 has a flat tongue 234 with two holes 232 and 233 for bolting the strap to either wooden beam 221 or wooden beam 219. Having two holes 232 and 233 in the mason's anchor strap 220 reduces the strength of the strap and is disadvantageous. The flat steel tongue of the anchor strap 220 is twisted ninety degrees at 235 such that a hooked blade 236 is created. The hooked blade 236 is twisted around the steel rebar 100 such as illustrated in FIG. 2C and then the tongue 234 is bolted to the wooden beam 221 or 219. FIG. 2C illustrates how two mason's anchor straps 219 and 220 are wrapped around the steel rebar 100 in order to provide for horizontal reinforcement and anchorage of the chimney. As a mason constructs the chimney brick by brick and liner by liner, horizontal reinforcing ties 208A–N are added at eighteen inch intervals. A mason may also fill the area 205 between the masonry work 128 and the chimney liner 104 with mortar if it is a reasonably small area. A mason continues in this manner in order to construct a new chimney having horizontal and vertical reinforcement.

Use of the mason's anchor strap 220 on preexisting chimneys physically requires that a chimney be at least broken down to the roof line. Installation of the horizontal reinforcing ties 208A–N at eighteen inch intervals requires that a majority of a pre-existing chimney be dismantled. Other codes in some cities require a pre-existing chimney to be completely broken down to the fireplace and then completely rebuilt in order to insert the mason's strap and horizontal reinforcing ties. After installing the mason's anchor strap 220 in a chimney, the mason must reconstruct the remaining portion of the chimney using new mortar. Dismantling a preexisting chimney and reconstructing a new chimney requires an expensive investment in labor and new materials. It is desirable that a preexisting chimney be retrofitted to meet horizontal reinforcement requirements without partially or completely removing the existing brick chimney thereby reducing the investment in labor and materials. It is desirable that a preexisting brick chimney be anchored to the house without partially or completely removing the existing brick chimney.

BRIEF SUMMARY OF THE INVENTION

A method and apparatus for seismically retrofitting pre-existing household brick chimneys is described to meet current building codes. Vertical steel rebar and horizontal chimney anchors are inserted into the chimney and a polymer concrete is poured between the liner and the brick masonry thereby bonding to the chimney, the vertical steel rebar, and the horizontal chimney anchors. The horizontal chimney anchors are coupled at one end to the external face of the chimney and at another end to the interior frame of the house. Holes are vertically drilled into the masonry of the chimney base in order to anchor the steel rebar at one end. Holes are drilled through the chimney and into the interior of the house at an appropriate point to properly anchor the pre-existing chimney to the house. A polymer concrete that has similar heat properties to other fireplace components is poured into the chimney around a chimney liner in order to reinforce and provide resiliency.

It is an object of the invention to retrofit a pre-existing chimney to current earthquake building code standards.

Another object of the invention is to retrofit a pre-existing chimney without removing or dismantelling the brick masonry unit.

A still further object of the invention is to horizontally and vertically reinforce a pre-existing chimney.

A still further object of the invention is to horizontally anchor a pre-existing chimney to the frame of a home.

BRIEF DESCRIPTIONS OF THE DRAWINGS

DETAILED DESCRIPTION OF THE PREFERRED EMBODIMENT

The method and apparatus for providing a seismic retrofit for preexisting household external wall chimneys is illustrated by FIGS. 3A–3E. The seismic retrofit for preexisting household external roof chimneys is illustrated by FIGS. 4A–4C. For either pre-existing chimney type the chimney is horizontally and vertically reinforced to meet current construction codes in order to withstand a reasonable size earthquake without harming persons or property.

External Wall Chimney

Figure 3A:
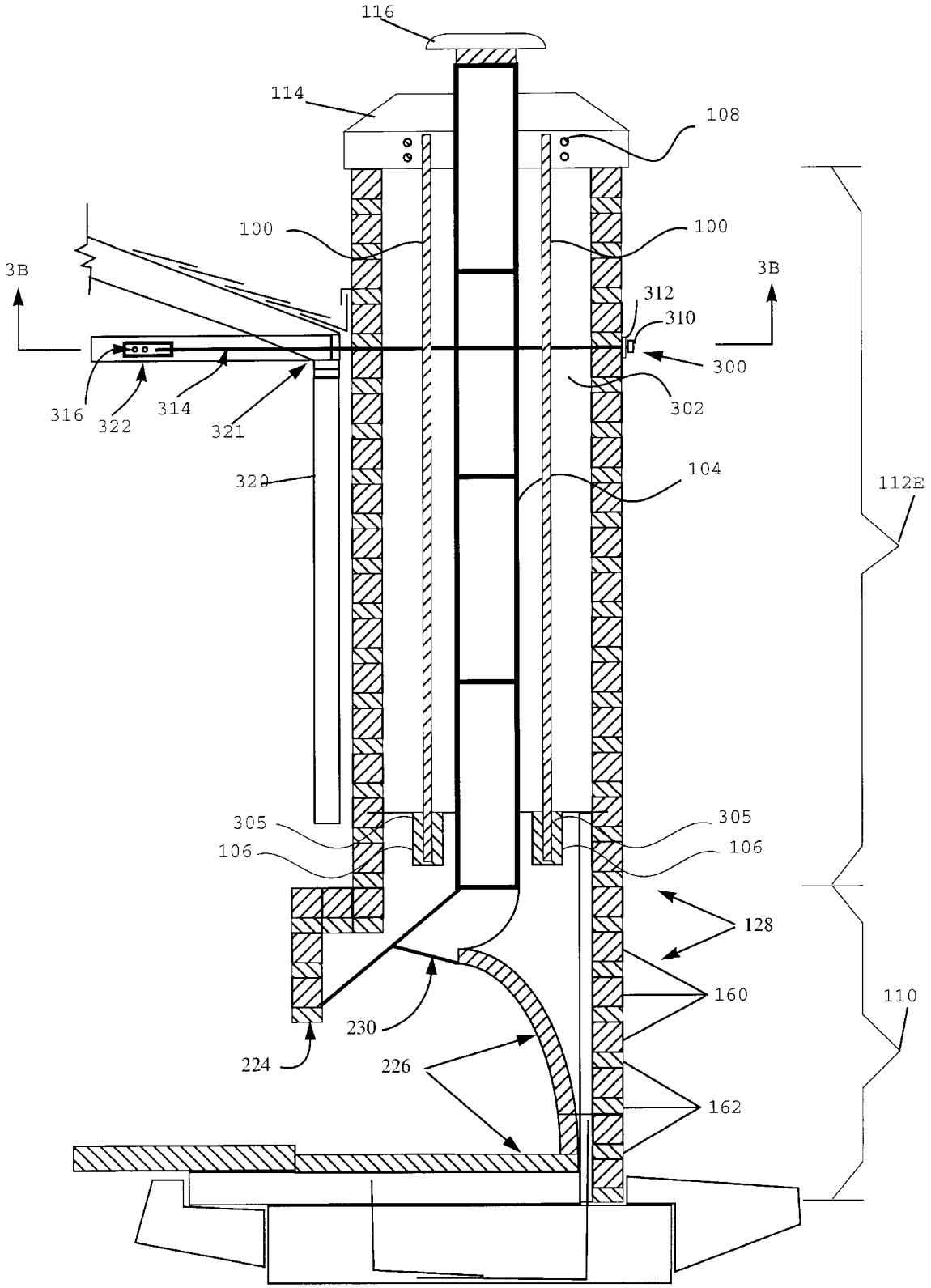
FIG. 3A illustrates a cross sectional side view of a fireplace and external wall chimney showing the horizontal tie of the present invention.
Figure 4A:
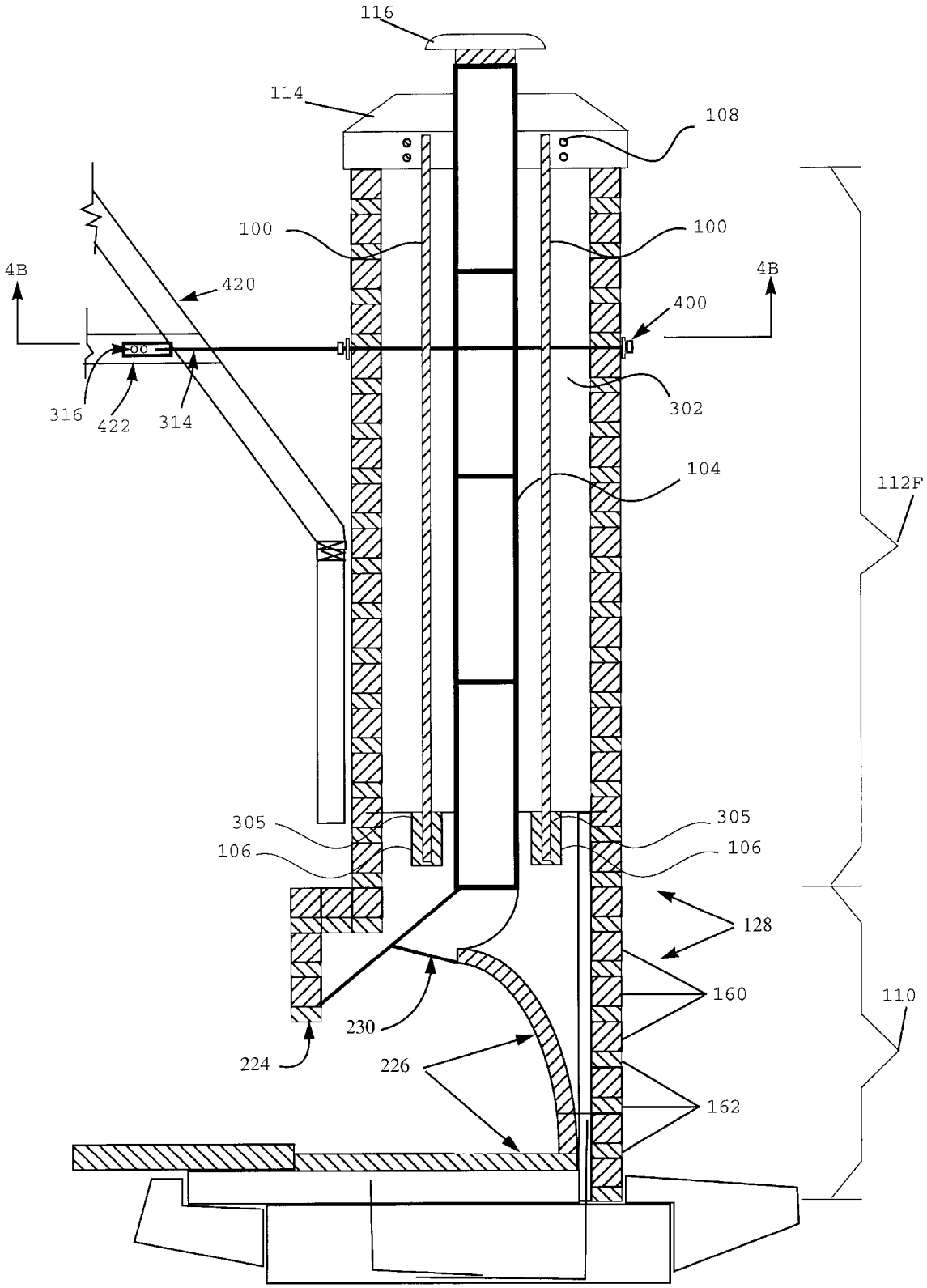
FIG. 4A illustrates a cross sectional side view of a external roof chimney and fireplace showing a second embodiment of the present invention.
Figure 4B:
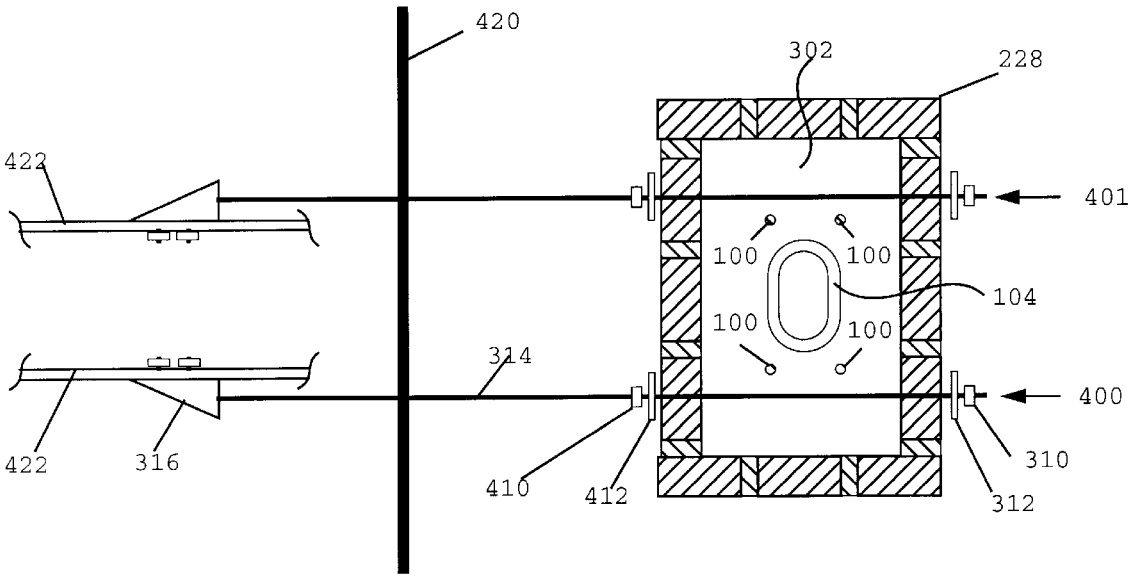
FIG. 4B illustrates a cross sectional top view of the external roof chimney and horizontal tie of the second embodiment of the present invention.
Figure 4C:
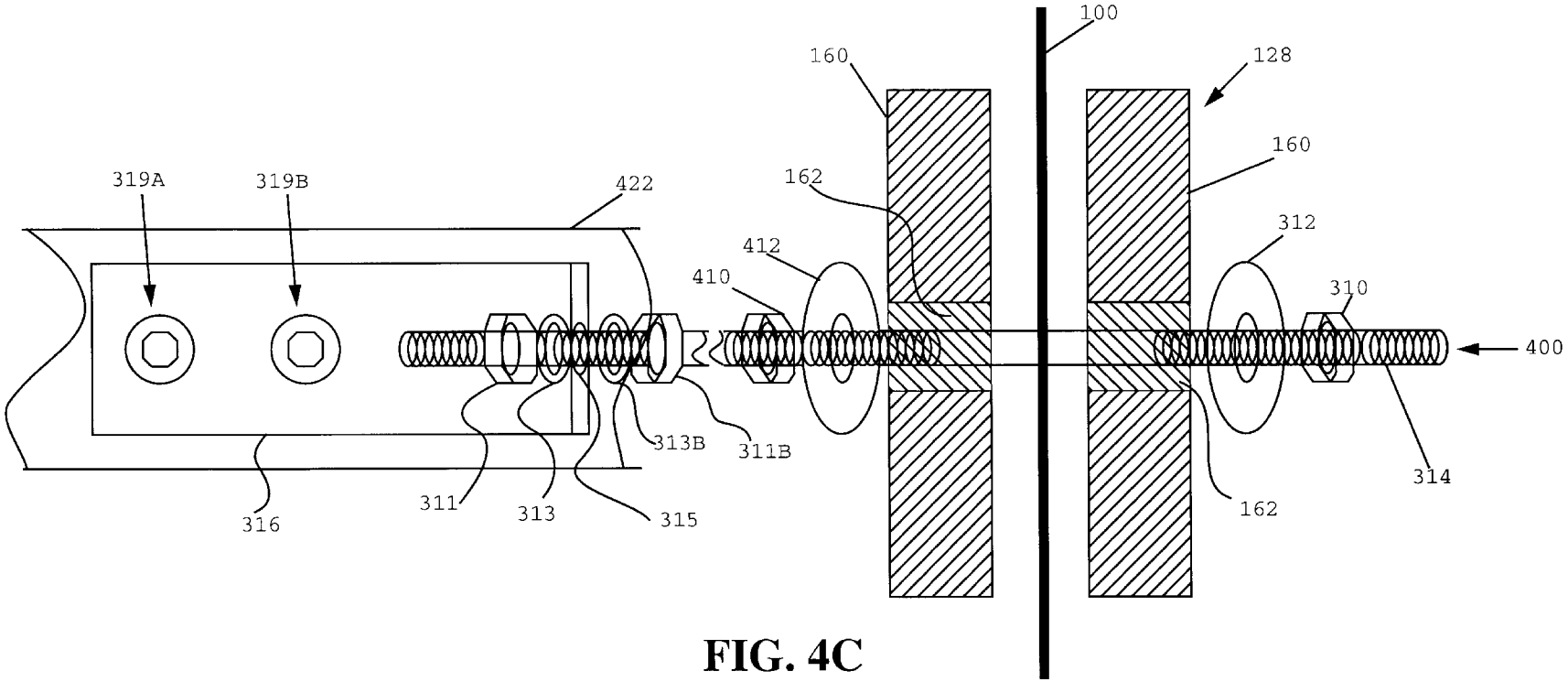
FIG. 4C illustrates a magnified side view of the horizontal tie of a second embodiment of the present invention.

FIG. 3A illustrates fireplace 110 and an external wall chimney 112E having the horizontal and vertical reinforcement of the present invention. Chimney 112E has a majority of its back side adjacent to wall 320. The horizontal reinforcement and anchorage provided by the present invention, referred to as a "chimney anchor", is illustrated at 300. Fireplace 110 includes the damper 230, lintel 224, and firebrick 226. Chimney 112E is coupled to fireplace 110 at its base and the mortar cap 114 and spark arrestor 116 at its top. The mortar and brick to construct the chimney 112E and fireplace 110 is collectively referred to as the brick masonry unit 128. Chimney 112E may further include a chimney liner 104 that may or may not have been present prior to the installation and method of the present invention. The non-reinforced chimney depicted by FIG. 1A may have not included the chimney liner 104.

The vertical reinforcement for chimney 112E includes at least four steel rebar 100 inserted within drilled holes 106 within the mortar 163 at the base of the chimney. The steel rebar 100 is a #4 (one half inch diameter) or #5 (five-eights inch diameter) steel rebar and is held within the holes by epoxy 305. To further horizontally and vertically reinforce the chimney and bond the steel rebar 100 and the "chimney anchor" 300 to the chimney, a reinforcement compound such as a polymer concrete 302 may be used to fill in the space between the chimney liner 104 and the brick masonry unit 128. The polymer concrete is preferable because of its resilience and its heat withstanding capabilities and properties that are similar to a terrocata chimney liner and the firebrick 226. Generally the polymer concrete is non-flammable and has a similar coefficient of heat expansion as that of a terrocata chimney liner and firebrick. To make polymer concrete a bonding agent such as "QUICKRETE Concrete Bonding Adhesive manufactured by the Quickrete Company of Atlanta, Ga. or "CEMLOK NE" bonding agent manufactured by the Conrad Sovig Co. Inc. of San Francisco, Calif. is added and mixed into concrete mortar. Because of its heat properties the polymer concrete can fill in voids in either the chimney liner 104 or the brick masonry unit of the chimney. Other reinforcing compounds including polymer concrete are further described in the book entitled "Fiber-Reinforced Cement Composites" by Perumalsamy N. Balaguru and Surendra P. Shah published by Mcgraw-Hill, Inc. If a chimney is large and requires an excess amount of polymer concrete the chimney may become too heavy in which case either a lightweight concrete aggregate may substituted such as Portcosta which is distributed by Granite Rock of San Francisco or a method of generating a reinforced web of polymer concrete can be used. Other lightweight concrete aggregates are further described in the book entitled "Lightweight Concrete" by Andrew Short and William Kinniburgh published by Wiley & Sons, Inc. To provide further vertical reinforcement, the bond beam 108, being a #2 steel rod is wrapped around the steel rebar 100 in the mortar cap 114.

The horizontal reinforcement of chimney 112E is further provided by two "chimney anchors" 300 and 301 one of which is depicted by the cross-sectional side view of FIG. 3A. In FIG. 3A "chimney anchor" is bolted against the exterior face of the chimney 112E and attached to the frame of the house at joist 322 by the bracket 316. FIGS. 3B–3E better illustrate the installation of the two chimney anchors.

Figure 3B:
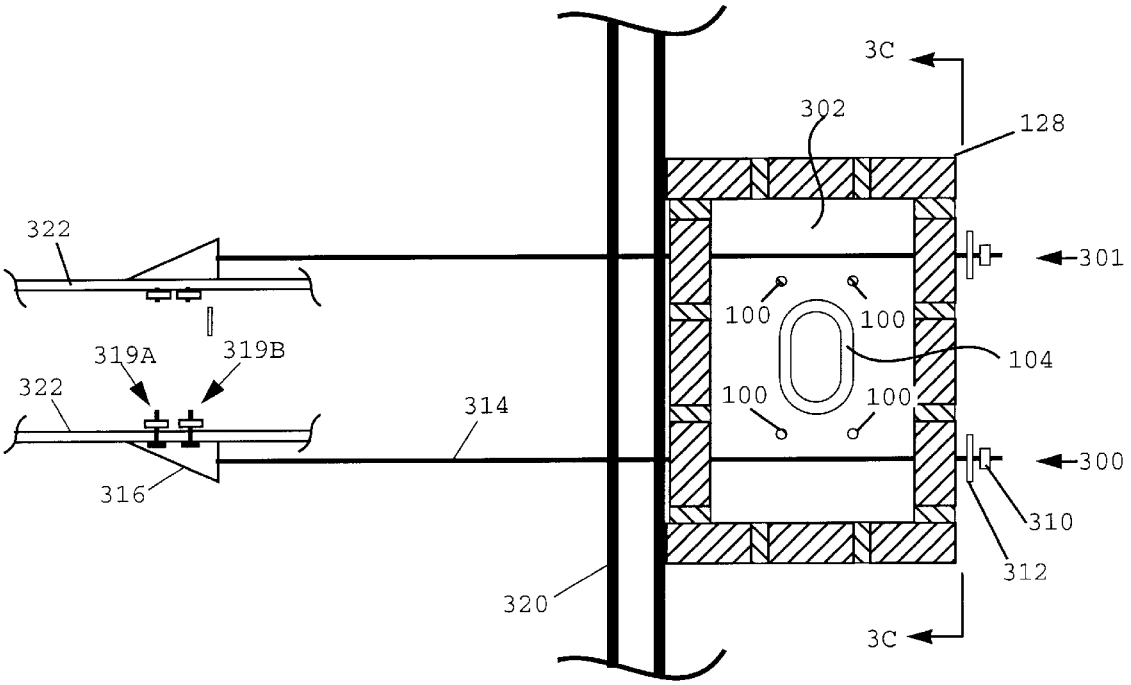
FIG. 3B illustrates a cross sectional top view of the wallmounted chimney and horizontal tie of the present invention.
Figure 3C:
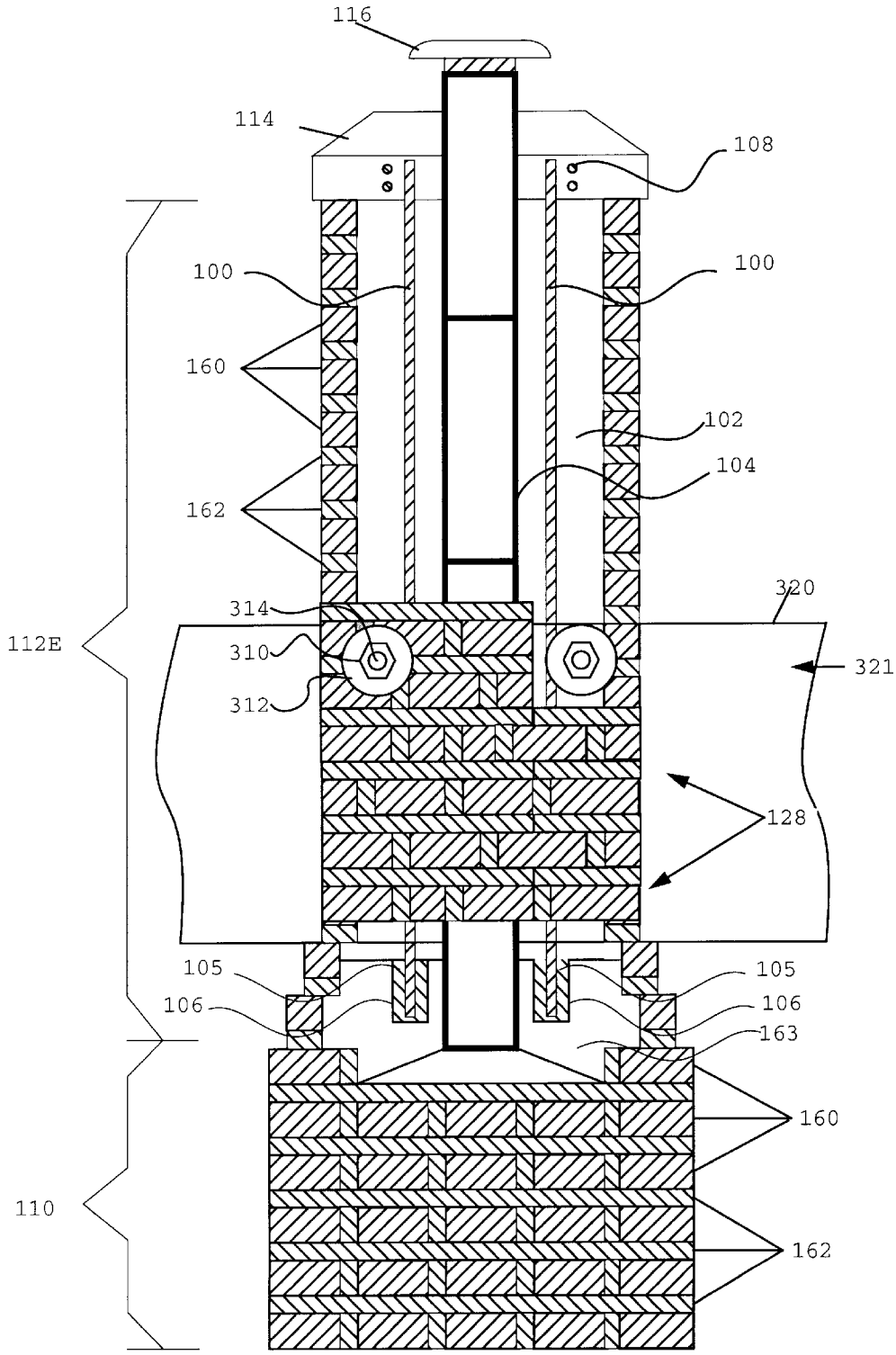
FIG. 3C illustrates a cutaway frontal view of the wallmounted chimney reinforced by the horizontal tie of the present invention.
Figure 3D:
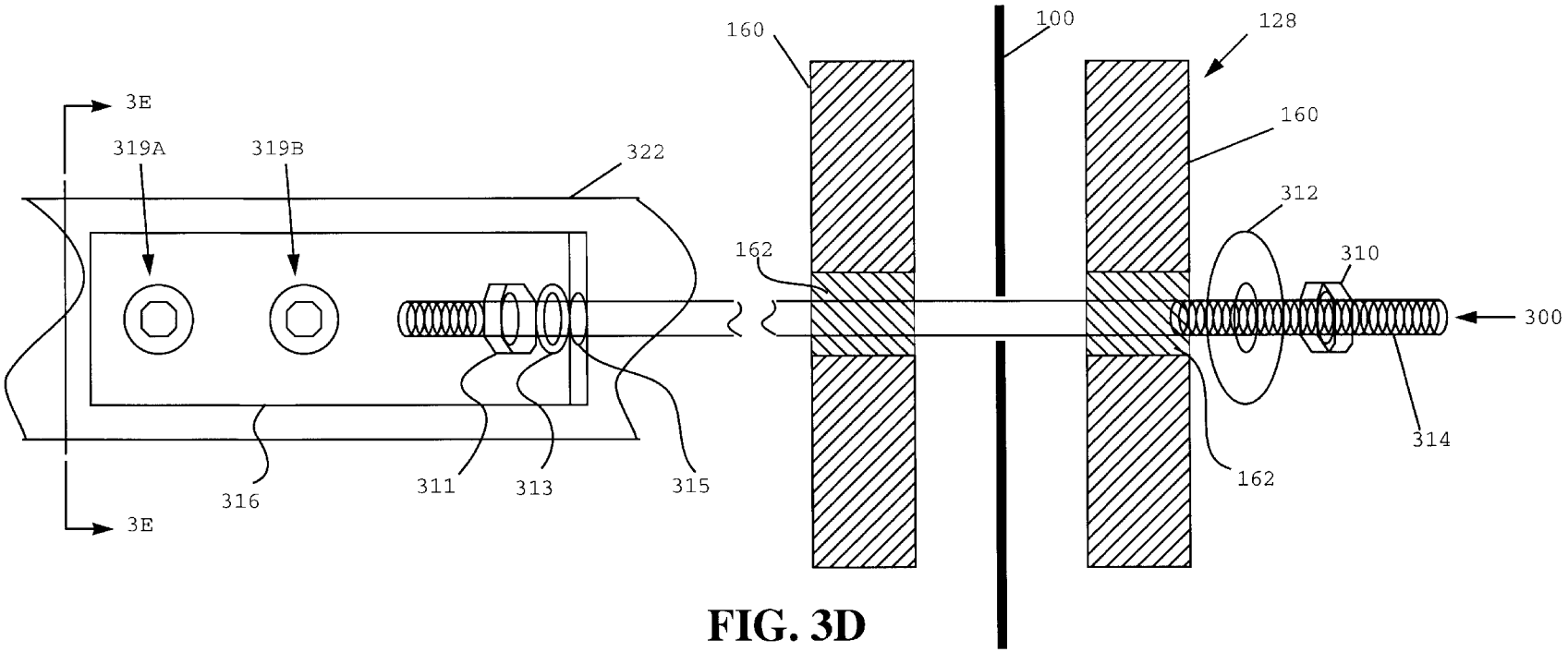
FIG. 3D illustrates a magnified side view of the horizontal tie of the present invention.
Figure 3E:
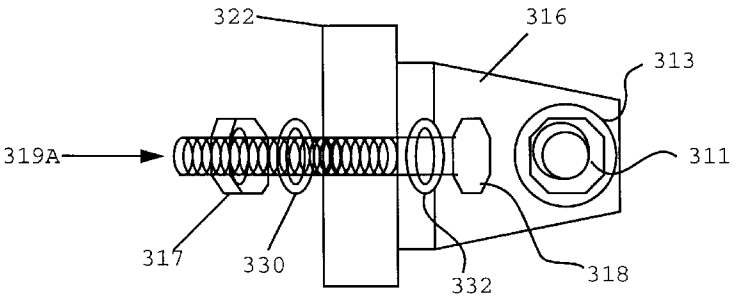
FIG. 3E illustrates a magnified rear view of a bracket of the horizontal tie of the present invention that may be coupled to the joist or rafter.

FIG. 3B illustrates a cross-sectional top view of chimney 112E having the two chimney anchors 300 and 301. FIG. 3D illustrates a magnified side view of each chimney anchor which consist of a threaded steel shaft 314, malleable washer 312, nut 310, bracket 316, bolt assemblies 319A and 319B, steel washer 313, and a nut 311. Referring to FIG. 3B, the threaded steel shaft 314 is approximately ten feet in length and is either a one half inch or five-eights inch diameter and is inserted into holes drilled through the chimney 112E and wall 320. As illustrated by FIG. 3B, holes are drilled through the chimney 112E in which to insert the shaft 314 between the steel rebar 100 and the left and right sides of the chimney, through the front and rear sides of the chimney, and may be drilled through the brick 160 or preferably through the mortar 162 as illustrated by FIG. 3C. Holes are further drilled through the wall 320 at the roof-line 321. The threaded steel shaft interior to the house may be shortened if necessary by sawing off a portion of the threaded steel shaft. At the external end of the shaft 314 a malleable washer 312 three inches in diameter with a one inch or seven-eights inch diameter hole is held against the chimney 112E by a nut 310. Referring to FIG. 3D bracket 316 is inserted over the steel shaft through hole 315. Bracket 316 may be a "Simpson STRONG TIE" bracket model number HD2A; NER-393 and is described in U.S. Pat. No. 4,665,672. Bracket 316 is then bolted to either a joist or a rafter 322 of the house by use of nut/bolt assemblies 319A and 319B. FIG. 3E illustrates nut/bolt assembly 319A in detail and how bracket 316 is held against the joist or rafter 322. A bolt 318 with a washer 332 is inserted through a hole in bracket 316 and a hole drilled through the joist or rafter 322. A washer 330 is inserted over the bolt 318 and a nut 317 is threaded onto the bolt and tightened such that the bracket is held tightly against the joist or rafter 322 of the house. The diameter of bolt 318, washer 332, washer 330, and nut 317 depends upon the force applied by the weight of the chimney. Typically the diameter may be either one-half inch or five-eights inch. Referring to FIG. 3D, steel washer 313 is then inserted over the threaded steel shaft 314 and nut 311 is tightened in order to create tension in the steel shaft 314 and hold the chimney 112E to the house.

External Roof Chimney

FIG. 4A illustrates fireplace 110 and an external wall chimney 112F having horizontal and vertical reinforcement of a second embodiment of the present invention. Chimney 112F has a majority of its chimney height above the roof-line. The horizontal reinforcement provided by the second embodiment of the present invention, also referred to as "chimney anchor", is illustrated at 400. The fireplace 110 is identical to that of FIG. 3A and is described above. Chimney 112F is similar to chimney 112E described above except for the fact that a majority of the chimney rises above the roof-line due to a semi-vaulted ceiling and the apparatus 400 used for horizontal reinforcement and anchorage is slightly different.

The vertical reinforcement for chimney 112F is similar to the vertical reinforcement for chimney 112E that is described above. The reinforcement compounds for chimney 112F are similar to the reinforcement compounds used for chimney 112E.

The horizontal reinforcement and anchorage of chimney 112F is further provided by two "chimney anchors" 400 and 401 one of which is depicted by the cross-sectional side view of FIG. 4B. In FIG. 4A, the "chimney anchor" 400 is bolted against the exterior face of the chimney 112F and attached to the frame of the house at rafter or joist 422 by the bracket 316. FIGS. 4B–4C better illustrate the installation of the two chimney anchors 400 and 401.

FIG. 4B illustrates a cross-sectional top view of chimney 112F having the two chimney anchors 400 and 401. FIG. 4C illustrates a magnified side view of each chimney anchor which consist of a threaded steel shaft 314, malleable washers 312 and 412, nuts 310 and 410, bracket 316, bolt assemblies 319A and 319B, steel washers 313, 313B, and nuts 311, 311B. Referring to FIG. 4B, the threaded steel shaft 314 is approximately ten feet in length and is either a one half inch or five-eights inch diameter and is inserted into holes drilled through the chimney 112F and roof 420. As illustrated by FIGS. 4A–4C, holes are drilled through the chimney 112F in which to insert the shaft 314. The holes for chimney anchor 400 is drilled between the steel rebar 100 and the left side of the chimney, through the front and rear sides of the chimney, and may be drilled through the brick 160 or preferably through the mortar 162. The holes for chimney anchor 401 is drilled between the steel rebar 100 and the right side of the chimney, through the front and rear sides of the chimney, and may be drilled through the brick 160 or preferably through the mortar 162. At the external end of the shaft 314, the malleable washer 312 three inches in diameter with a one inch or seven-eights inch diameter hole is held against the front side of chimney 112F by the nut 310. Additionally, the malleable washer 412 three inches in diameter with a one inch or seven-eights inch diameter hole is held against the rear side of chimney 112F by the nut 410. Nut 410 is tightened such that tension is created along the steel shaft 314 between nuts 410 and 310. The threaded steel shaft interior to the house that is inserted through the roof may be shortened if necessary by sawing off a portion of the threaded steel shaft 314.

Referring to FIG. 4C, nut 311B is threaded onto the steel shaft 314 and then washer 313B is slid onto the threaded steel shaft as well. Next, bracket 316 is inserted over the steel shaft through hole 315. Bracket 316 may be a "Simpson STRONG TIE" bracket model number HD2A; NER-393 and is described in U.S. Pat. No. 4,665,672. Bracket 316 is then bolted to either a rafter 422 or a joist of the house by use of nut/bolt assemblies 319A and 319B. FIG. 3E, described above, illustrates the nut/bolt assembly 319A in detail and how bracket 316 is similarly held against the rafter or joist 422. Referring to FIG. 4C, steel washer 313 is then inserted over the threaded steel shaft 314 and nut 311 is then threaded onto the steel shaft. Nuts 311 and 311B are tightened against the bracket 316 in order to create tension in the steel shaft 314 and hold the chimney 112F to the house.

Method of Seismically Retrofitting Pre-existing Chimneys

Figure 1A:
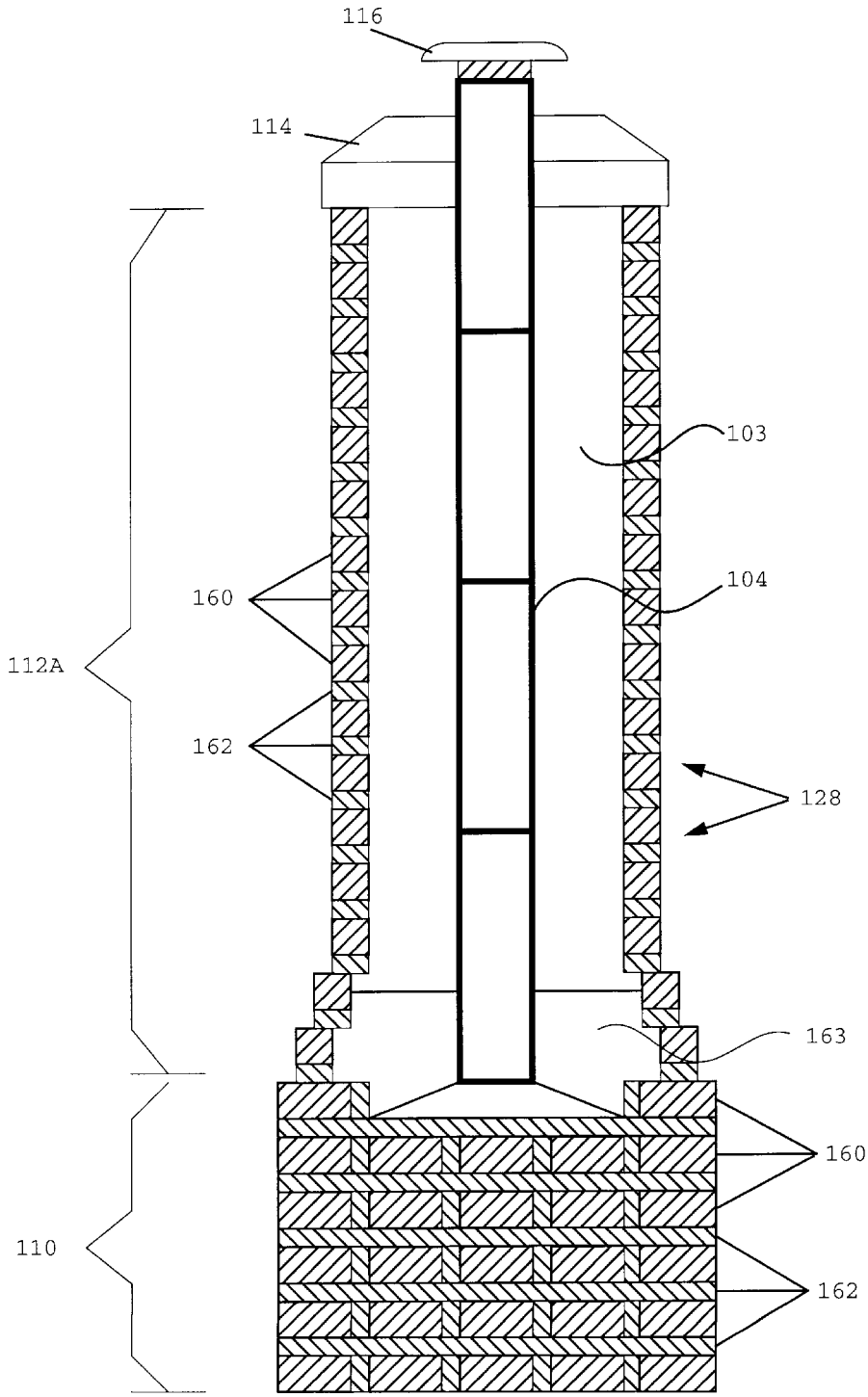
FIG. 1A (Prior Art)
FIG. 1A shows a cutaway diagram of a front view of a fireplace with a non-reinforced external wall chimney.
Figure 1B:
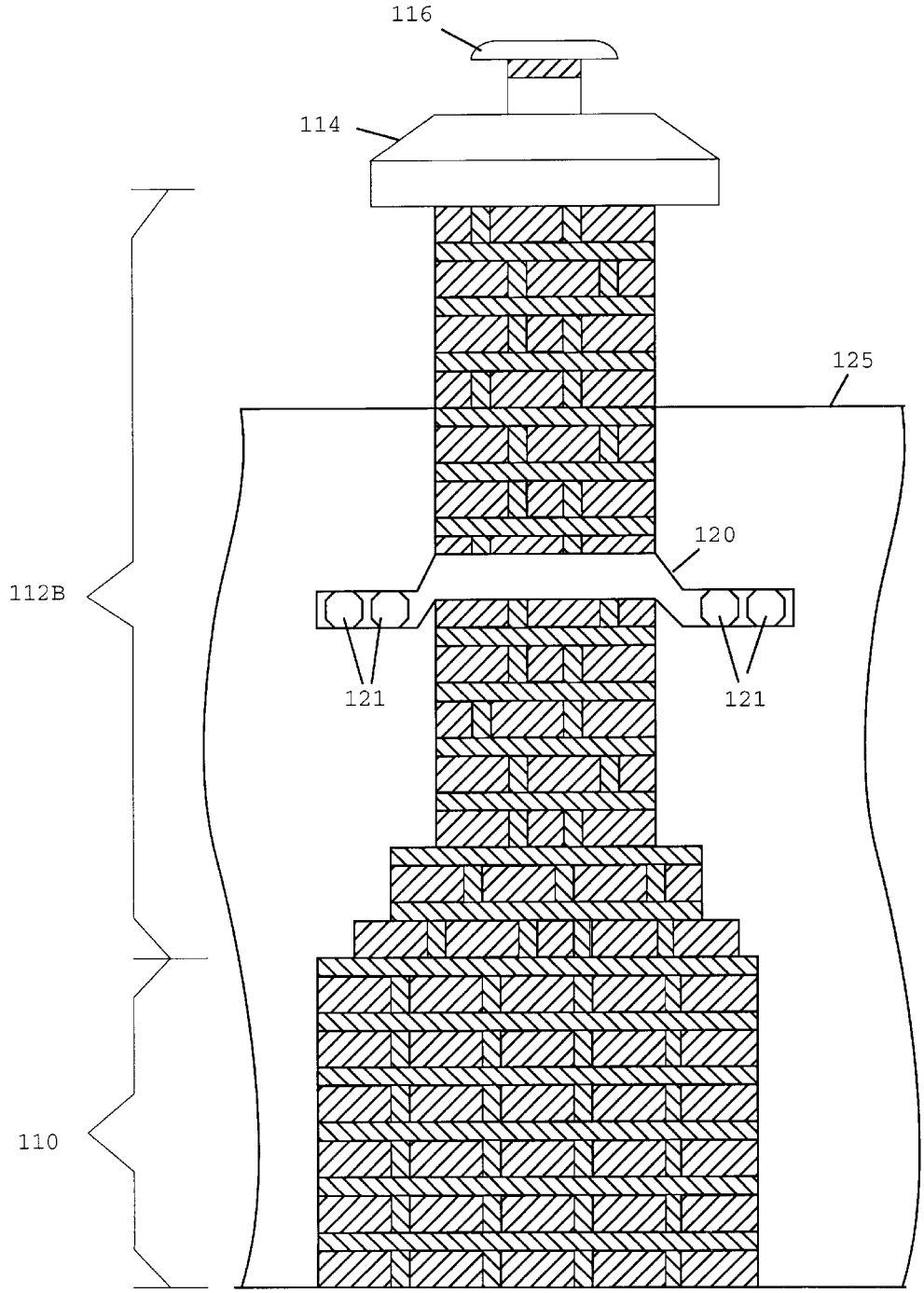
FIG. 1B (Prior Art)
FIG. 1B shows a front view of a fireplace and an external wall chimney using a prior art chimney strap for horizontal anchorage.

Prior to retrofitting a pre-existing chimney it must be inspected to be sure that the non-reinforced chimney 112A such as illustrated by chimney 112A in FIG. 1A is sound and can be reinforced. If the non-reinforced chimney is so badly cracked or damaged the chimney must be completely rebuilt. The pre-existing chimney is visually inspected for cracks and is also pull tested by a human to see if there is significant lateral movement or rotation in the chimney that would prevent adding the horizontal and vertical reinforcement of the present invention. The spark arrestor 116, if one is in place, is removed to determine if the chimney 112A has a chimney liner 104 and in order to make a computation of space 103 based on the dimensions of the chimney. Further the mortar cap 114 is inspected and may be removed to further determine if it appears there is a space 103 in which drilling equipment can be used to drill the holes 106 in which the steel rebar 100 can be inserted. If there are obstructions that would prevent drilling holes 106 then the chimney may not be capable of retrofitting. If there is no chimney liner 104 a determination may be made as to whether a chimney liner may be installed within the center of the existing brick masonry unit. Nearly all existing chimney building codes require that a chimney liner be installed within the brick masonry unit. If a chimney liner 104 is to be installed then holes 106 may not necessarily need drilling and the steel rebar 100 is cemented into the area around the fireplace along with the first section of the chimney liner 104.

Figure 5A:
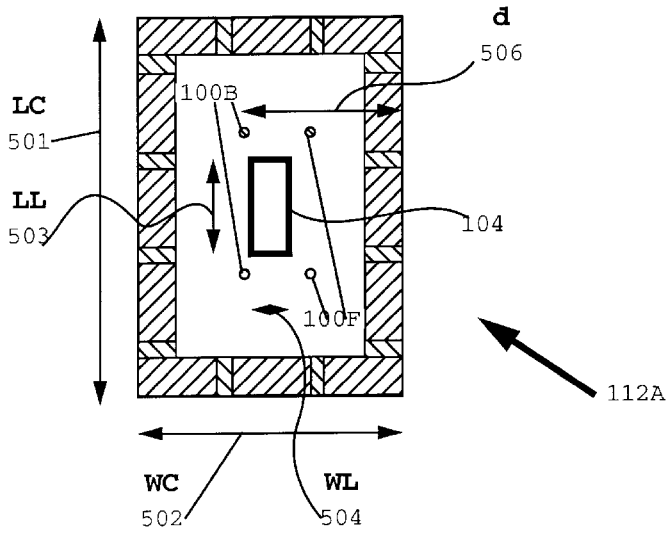
FIG. 5A illustrates the cross sectional top dimensions of a wallmounted chimney in order to compute the strength of materials for the present invention.

Once it is determined that the chimney can be retrofitted with the horizontal and vertical reinforcement of the present invention, measurements are made of the chimney and fireplace in order to determine if the foundation of the fireplace is strong enough to support the added weight and the strength and positions of the needed materials to provide the horizontal and vertical reinforcement of the present invention. Referring to FIG. 5A, the width (WC) 501 of the chimney and length (LC) 502 of the chimney are measured. The width (WL) 503 of the chimney liner and the length (LL) 504 of the chimney liner are measured. From these measurements the amount of area (A) between the chimney liner and the mortar unit can be approximated by the equation:

$$A=[(WC\times LC)-(WL\times LL)]. \qquad \text{Eq. 1}$$

Figure 5B:
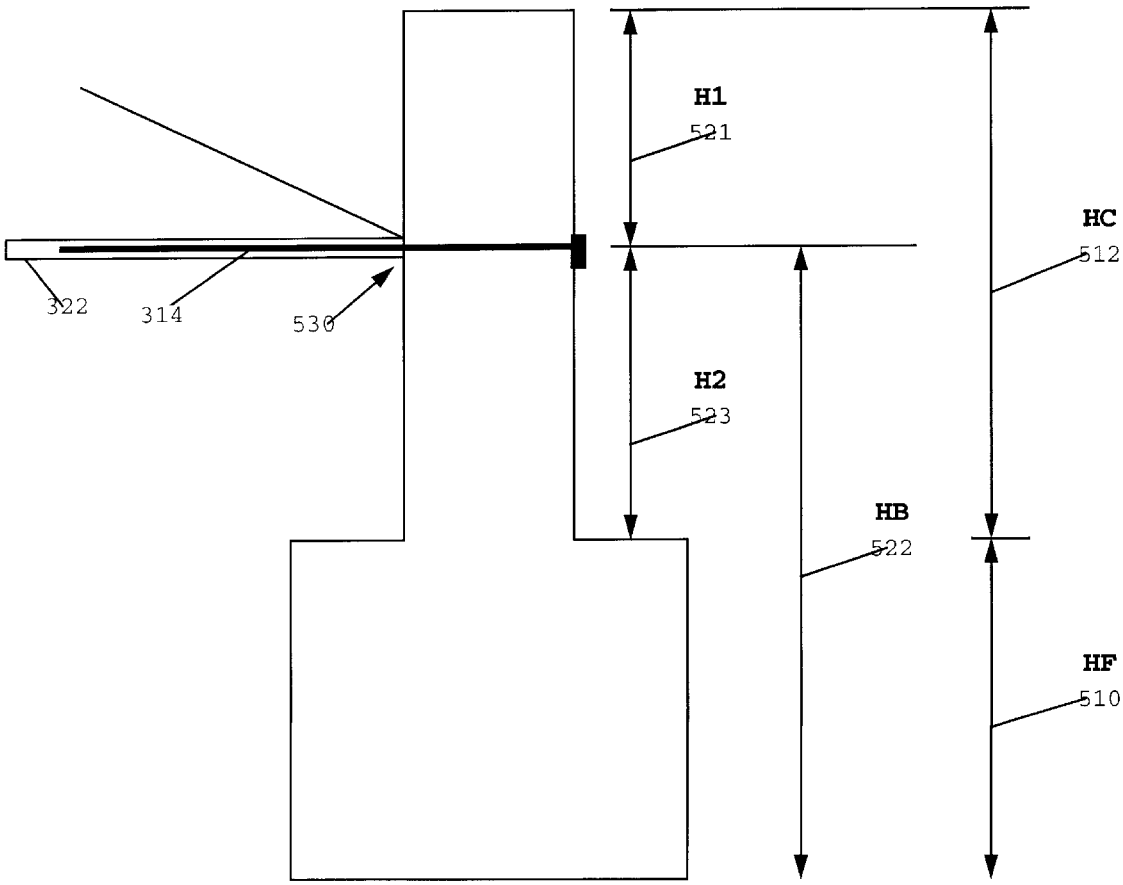
FIG. 5B illustrates the cross sectional side dimensions of a fireplace and external wall chimney in order to compute the strength of materials for the present invention.

Referring to FIG. 5B, the height of the fireplace (HF) 510 and the total height of the chimney (HC) 512 is measured. An inspection of the attic of the home is made and a determination is made as to where the two chimney anchors may be installed. Knowing where the chimney anchors will be installed the distance between the top of the chimney and the chimney anchor (H1) 521 can be determined. From these measurements the height of the chimney anchor(HB) 522 that provides bracing can be determined by the equation:

$$HB=HC+HF-H1 \qquad \text{Eq. 2}$$

The total height (HT) of the structure at the top of the chimney can be determined from the equation:

$$HT=HC+HF \qquad \text{Eq. 3}$$

Knowing these measurements, a professional engineer can make estimates as to the chimney weight, the vertical bending force upon the steel rebar 100, and the horizontal force upon the chimney anchor 300 or 400 can be computed to assure the proper diameter of bolts, steel shaft and rebar has been selected. Consider for example a chimney having the following measurements:

H1=5 ft, HC=11 ft, HF=7 ft,

WC=17 in, LC=30 in, WL=8 in, LL=17 in.

The area (A) between the chimney liner and the mortar unit is computed by the Eq. 1:

$$A=[(17\text{ in}\times 30\text{ in})-(8\text{ in}\times 17\text{ in})]=374\text{ in}^2.$$

The height of the chimney anchor is computed by Eq. 2 to be:

$$HB=11\text{ ft}+7\text{ ft}-5\text{ ft}=13\text{ ft}.$$

The total height of the structure is computed by Eq. 3 to be:

$$HT=11\text{ ft}+7\text{ ft}=18\text{ ft}.$$

Next the chimney weight per foot of height is computed by the equation:

$$W=A\times[(120\text{ lbs/ft}^3)/(144\text{ in}^2/\text{ft}^2)] \qquad \text{Eq. 4}$$

The number (120 lbs/ft$^3$) represents the weight of masonry per cubic foot while the number (144 in$^2$/ft$^2$) is a conversion factor. Using the example values the chimney weight per foot computes to be:

$$W=374\ \text{in}^2\times[(120\ \text{lbs/ft}^3)/(144\ \text{in}^2/\text{ft}^2)]=312\ \text{lbs/ft}$$

Next the horizontal force applied by an earthquake to the chimney is computed with reference to the top of the chimney by the equation provided in the 1991 Uniform Building Code:

$$F_p=ZIC_pW \qquad \text{Eq. 5}$$

The factor Z is a seismic zone factor and varies depending upon the geographic location of the chimney. The highest zone is zone 4 such that the Z factor becomes 0.40. The factor I is an occupancy factor in which case for a standard occupancy structure such as a home the value is 1.00 for earthquake computations. The factor $C_p$ is a horizontal force factor and its value varies depending upon the height measurements above. If the chimney anchor is fastened below the roof such as in FIG. 3A and the chimney extends above the chimney anchor less than one half the total height of the structure, then $C_p$=0.75. If the chimney anchor is fastened above the roof such as in FIG. 4A at or above the center of mass or if the chimney extends above the chimney anchor more than one half the total height of the structure when the chimney anchor is fastened below the roof such as in FIG. 3A, then $C_p$=2.00. Continuing with the example as illustrated by FIG. 5B, we need to know if:

$$H1<(HT/2) \qquad \text{Eq. 6}$$

to determine the value for $C_p$. Substituting in the values from above we find:

$$5\ \text{ft}<(18\ \text{ft}/2)\ \text{or}\ 5\ \text{ft}<9\ \text{ft}$$

such that the value for $C_p$ is 0.75. Now knowing all variables for Eq. 5 we can compute the horizontal force per foot to be:

$$F_p=(040)(1.00)(0.75)(312\ \text{lbs/ft})=93.6\ \text{lbs/ft}.$$

Now knowing how much force will be applied by the earthquake, bending of the chimney occurring at the chimney anchor can be computed in order to determine the diameter of the steel rebar 100 necessary to avoid a tension failure and toppling of the chimney above the chimney anchor. The area of the steel (As) required to resist tension forces may be computed from:

$$As=M_1/(ad) \qquad \text{Eq. 7.}$$

In determining the bending of the chimney occurring at the chimney anchor, "$M_1$" is the moment applied to the chimney by the earthquake force, "d" is the distance from the compression face of the brick to the center of the reinforcing steel that is being stretched, and "a" is equal to the (average j-value)*($f_s$/12,000). $f_s$ is the allowed stress of steel in steel reinforced concrete and the average j-value approximates the center of gravity where there is a couple that resists a moment. Knowing the compressed stress for the applied concrete (f'c) and the allowed stress of steel ($f_s$), a table for Rectangular Sections of steel reinforced concrete that approximates the reinforced chimney may be used to determine the value for "a". For example consider f'c is 2000 and $f_s$ is 20,000 lbs/in$^2$, using Table 1 for rectangular sections from the Reinforced Concrete Design Handbook by Thor Germundsson et al, the value for "a" is 1.44. The value for "d" is illustrated by "d" 506 in FIG. 5A. For a brick that is four inches in width, the value of "d" may be approximately ten (10 in) inches.

The moment "$M_1$" applied to the chimney against two of the steel rebar 100B may be computed from:

$$M_1=(F_p*H1)*(H1/2) \qquad \text{Eq. 8}$$

From this equation it can be seen that it is preferable to place the chimney anchor such that H1 is smaller while maintaining a strong attachment to the homes frame. Continuing with the example, moment $M_1$ may be computed as $$M_1=(93.6\ \text{lbs/ft})*5\ \text{ft})*(5\ \text{ft}/2)=1{,}170\ \text{ft-lbs}$$

which can be converted to ft-kips using the conversion factor 1 kip/1000 lbs such that $$M_1=(1{,}170\ \text{ft-lbs})*(1\ \text{kip}/1000\text{lbs})=1{,}170\ \text{ft-kips}.$$

The area of steel required may now be determined by using Eq. 7.

As=(1.170 ft-kips)/[(1.44 ft-kips/in$^3$)*(10 in)]=0.08 in$^2$. As discussed above the steel rebar 100 may be a #4 (one half inch diameter, one quarter inch radius) or #5 (five-eights inch diameter, five-sixteenths inch radius) steel rebar. The area of a single steel rebar may be computed from the area equation for a circle:

$$Ac=\pi r^2 \qquad \text{Eq. 9}$$

For #4 steel rebar the area may be computed as $$Ac4=(3.14)(0.25\ \text{in})^2=0.20\ \text{in}^2.$$

For #5 steel rebar the area may be computed as $$Ac5=(3.14)(0.3125\ \text{in})^2=0.31\ \text{in}^2.$$

Using the #4 steel rebar as steel rebar 100B or steel rebar 100F at each corner of the chimney as depicted in FIG. 5A, the area of steel for the stretch of back steel rebar 100B or the front steel rebar 100F may be computed by the equation $$As4=2*(0.20\ \text{in}^2)=0.40\ \text{in}^2$$

This value of As4 surpasses the required steel area of 0.08 in$^2$ computed above. If this was not the case a larger diameter steel rebar would have been chosen.

Next the lateral force at the eave 530 is determined in order to compute the bolts and threaded steel shaft to be used in assembling each chimney anchor. Taking moments at the top of the fireplace the force at the eave may be calculated using the equation:

$$Fe=[(F_p)*(HC)^2]/[2*(H2)] \qquad \text{Eq. 10}$$

Using the values from above we may compute the force from $$Fe=[(93.6\ \text{lbs/ft})*(11\ \text{ft})^2]/[2*(6\ \text{ft})]=943.8\ \text{lbs}.$$

The force upon each chimney anchor is one half the total force Fe or 471.9 lbs which is used to compute the diameter of the bolts 318, the threaded steel shaft 314 and the strength of the malleable washer 312.

The tension force capability of the threaded steel shaft 314 may be computed from the equation:

$$Ft=(At)(SK)(SI) \qquad \text{Eq. 11.}$$

"At" is the tension area of the threaded steel shaft 314, "SK" is the allowable stress in the threaded steel shaft 314, and "SI" is an earthquake increase factor due to the limited duration of the load. For a one-half inch diameter threaded steel shaft 314 the values of these factors from the 1991 Uniform Building code are:

$$At=0.14\ \text{in}^2,\ SK=20{,}000\ \text{lbs/in}^2,\ SI=1.33.$$

The tension capability of the threaded steel shaft 314 may be computed to be $$Ft=(0.14\ \text{in}^2)(20{,}000\ \text{lbs/in}^2)(1.33)=3724\ \text{lbs}.$$

Comparing Fe with Ft, it is determined if the tension capability of the threaded steel shaft 314 exceeds the force applied at the eave such that it is a proper diameter. In the example above, Ft (3724 lbs) is greater than Fe (943.8 lbs) such that the diameter of the steel shaft 314 is sufficient. If Ft was less than Fe, then a larger diameter threaded steel shaft 314 would be selected such as five-eights of an inch.

The shear force capability of the bolts 318 holding one bracket 316 to the rafters or joist 322 may be computed using the equation $$Fs=(B)(F)(SI) \qquad \text{Eq. 12}$$

"B" is the number of bolts 318 used to hold bracket 316, which in this case is two in number. "F" is the allowable shear stress on the bolts 318 obtained from Table 8.2B of the 1991 Edition of the "National Design Specification for Wood Construction". Considering the bolts 318 to be one-half inch in diameter and the rafter or joist 322 to be one and one-half inch in thickness, the value for F is 530 lbs/bolt. "SI" is the earthquake increase factor due to the limited duration of the load. From the 1991 Uniform Building code, SI=1.33. The shear force may then be computed to be $$Fs=(2\ \text{bolts})(530\ \text{lbs/bolt})(1.33)=1409\ \text{lbs}$$

Comparing Fs with Ft, it is determined if the shear force capability of the bolts 318 exceed the force applied at the eave such that it is a proper diameter. In the example above, Fs (1409 lbs) is greater than Fe (943.8 lbs) such that the diameter of the bolts 318 is sufficient. If Fs was less than Fe, then a larger diameter bolt would be selected such as five-eights of an inch.

Through the use of the above example and equations, the strength of materials for external roof chimneys as illustrated by FIGS. 4A–C may be determined as well.

After these calculations are made these are submitted to the city building department for approval. Once approved and a permit is issued the retrofit of the pre-existing chimney may begin.

Figure 1C:
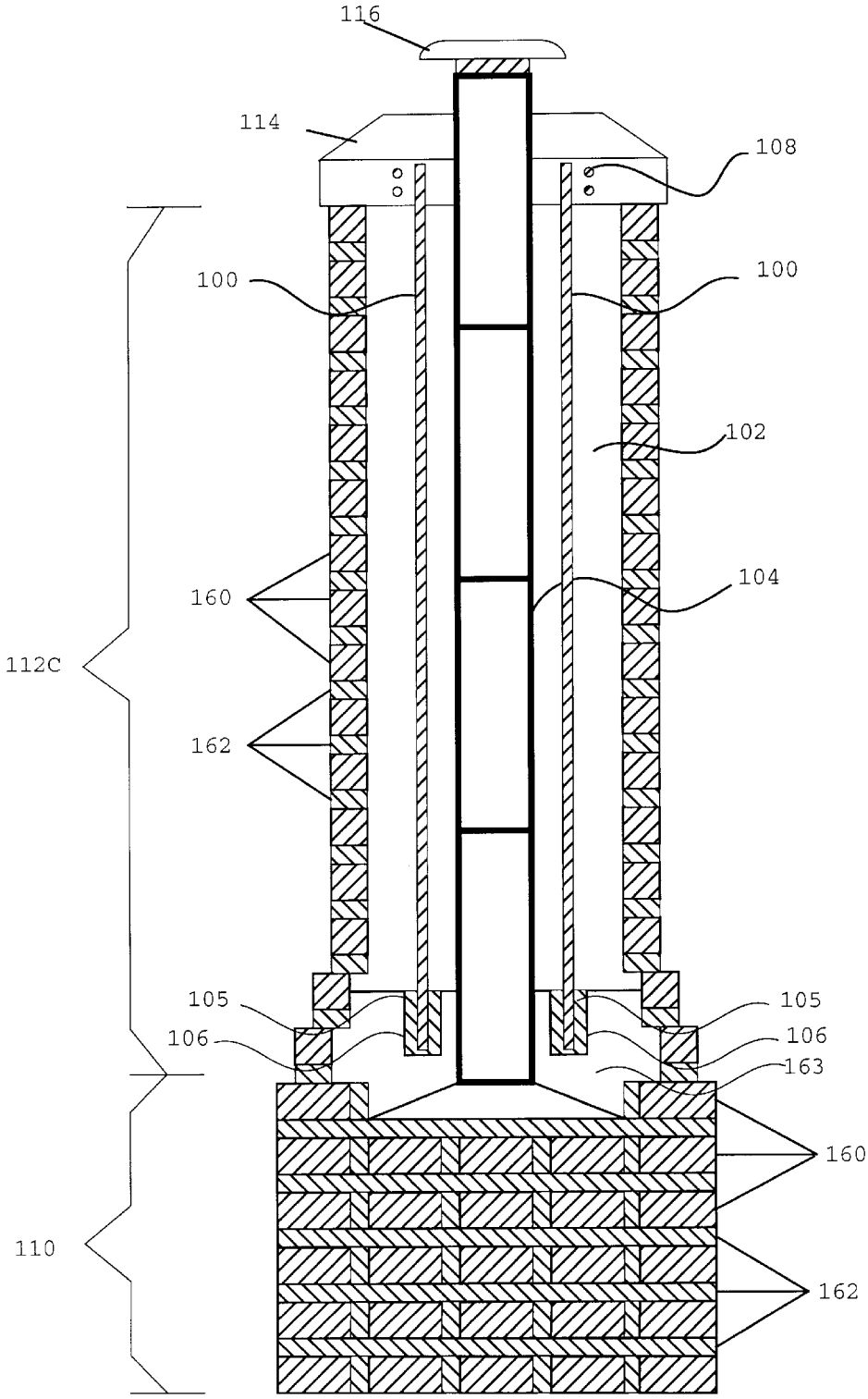
FIG. 1C (Prior Art)
FIG. 1C shows a cutaway diagram of a front view of a fireplace and an external wall chimney that illustrates the vertical reinforcement used to retrofit older chimneys.
Figure 2A:
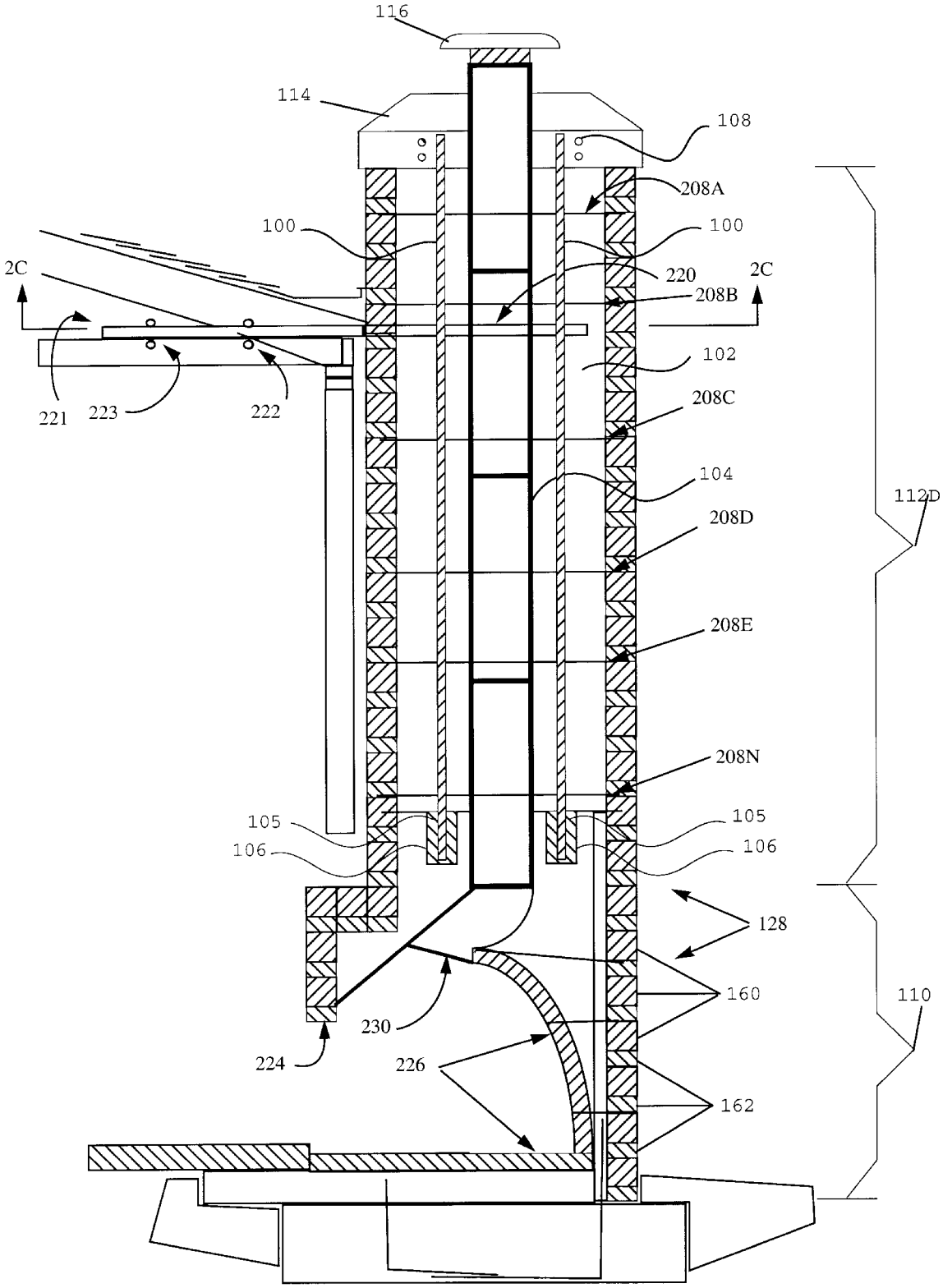
FIG. 2A (Prior Art)
FIG. 2A shows a cross sectional side view of a fireplace and chimney illustrating the horizontal reinforcement used in the construction of new chimneys.
Figure 2C:
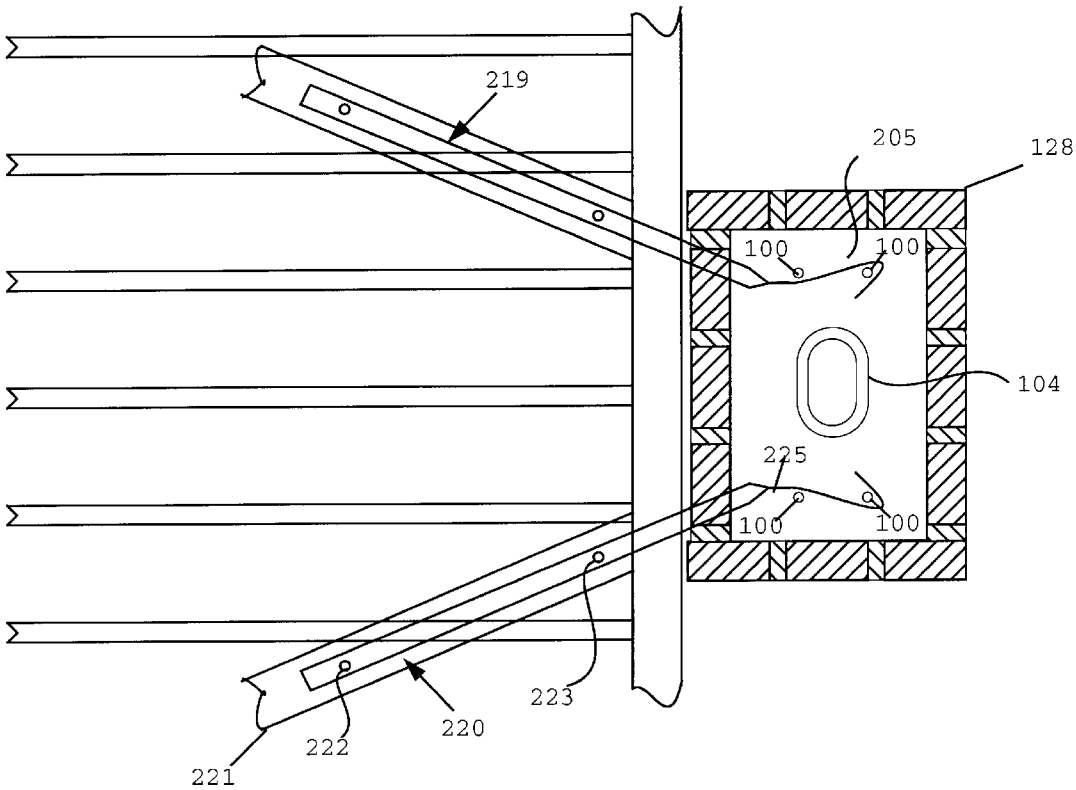
FIG. 2C (Prior Art)
FIG. 2C is a cross sectional top view of the new chimney construction of FIG. 2A illustrating the masons strap as horizontal reinforcement.
Figure 2B:
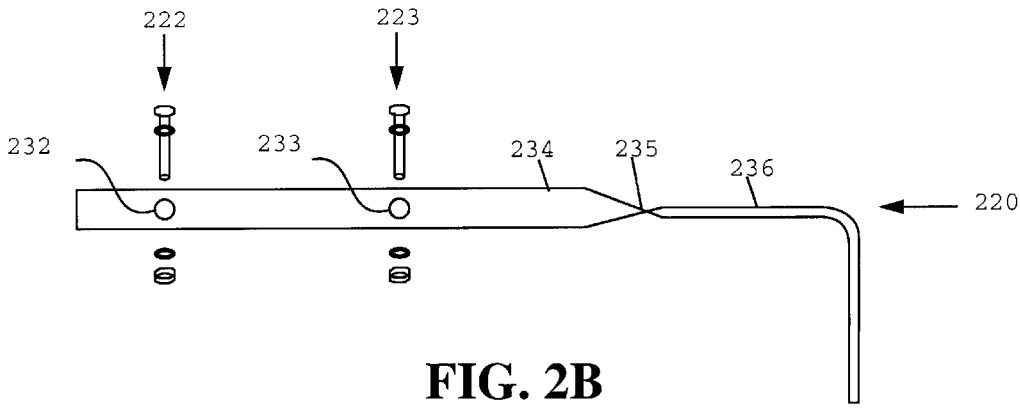
FIG. 2B (Prior Art)
FIG. 2B illustrates a top view of a new uninstalled mason strap that is used in the construction new chimneys.

Referring to FIG. 1A, the spark arrester 116 and the mortar cap 114 are removed if not already. Drilling equipment is first used to drill the two horizontal holes through the front and rear of the chimney 112E or 112F and through the wall 320 or roof 420 as required for the two chimney anchors 300 and 301 or 400 and 401. It is preferable to drill through a mortar joint of the mortar 162 of the brick masonry unit 128 instead of the brick 160 because of the ease and speed of drilling the horizontal holes. The holes for the chimney anchors in the chimney are drilled on each side of the chimney liner 104 in the space 103 between the chimney liner and the brick masonry unit 128 such that each chimney anchor will be inserted outside the steel rebar 100. Next the drilling equipment is used to drill through obstructions over the height of the chimney in the space 103 and into at least four holes 106 near the corners of the chimney box mortar 163 as illustrated by FIG. 1C. Drilling into the chimney box mortar 163 assures that the steel rebar 100 extends the full height of the chimney. The rubble and debris generated by the drilling is vacuumed out to clear holes 106 by using vacuuming equipment.

Steel rebar 100 is then inserted into each of the holes 106 and an epoxy 305 is used to fill the holes 106 and hold one end of each of the steel rebar 100. Next the two chimney anchors 300 and 301 or 400 and 401 as the case may be are installed into the horizontal holes drilled into the chimney and the house.

In the case of chimney anchors 300 and 301 as illustrated by FIGS. 3A–3E they are installed as follows. Referring to FIG. 3B, the malleable washer 312 is inserted over an external end of the threaded steel shaft 314. The nut 310 is screwed onto the threaded steel shaft 314 such that a few threads are left exposed on the external end. The internal end of the steel shaft 314 is inserted into holes drilled through the chimney 112E. The internal end is pushed through the holes drilled into the chimney and the wall 320. A hammer is used on the external end to finally pound the steel shaft 314 in place as well as damage a few exposed threads such that the malleable washer 312 and nut 310 will not loosen and fall off the steel shaft. The interior end of the threaded steel shaft may be shortened if necessary by sawing off a portion of the threaded steel shaft. However, it is preferable to use the entire length in order to grab the frame of the house more closely to the center of mass of the house. Referring to FIG. 3D, bracket 316 is inserted over the internal end of the steel shaft through hole 315. Bracket 316 is then bolted to the either a joist or a rafter 322 of the house by use of nut/bolt assemblies 319A and 319B. It is preferable that a joist be used to mount the bracket. Holes where the bracket 316 may be mounted are drilled through the wooden joist or rafter 322. FIG. 3E illustrates nut/bolt assembly 319A in detail and how bracket 316 is held against the joist or rafter 322. A bolt 318 with a washer 332 is inserted through a hole in bracket 316 and the hole drilled through the joist or rafter 322. A washer 330 is inserted over the bolt 318 on the opposite side of the joist or rafter 322 and a nut 317 is threaded onto the bolt and tightened such that the bracket is held tightly against the joist or rafter 322 of the house. Referring to FIG. 3D, steel washer 313 is then inserted over the threaded steel shaft 314 and nut 311 is tightened in order to create tension in the steel shaft 314 and hold the chimney 112E to the house.

In the case of chimney anchors 400 and 401 as illustrated by FIGS. 4A–4C they are installed as follows. Referring to FIG. 4B, the malleable washer 312 is inserted over an external end of the threaded steel shaft 314. The nut 310 is screwed onto the threaded steel shaft 314 such that a few threads are left exposed on the external end. The internal end of the steel shaft 314 is inserted into holes drilled through the chimney 112E. The internal end is pushed through the holes drilled into the chimney until the internal end of the threaded steel shaft 314 is exposed on the back side of the chimney. Malleable washer 412 is inserted over the internal end of the steel shaft and the nut 410 is threaded onto the internal end. If the threads on the internal end are damaged by being pushed through the chimney they are cleaned up by using a die of the appropriate size such that nut 410 can be threaded onto the steel shaft 314. The steel shaft is then further pushed through the chimney and inserted through the holes drilled into the roof 420. As the steel shaft is pushed through, the nut 410 is further tightened onto the steel shaft towards the chimney 112F carrying the malleable washer 412 with it. A hammer is used on the external end to finally pound the steel shaft 314 in place as well as damage a few exposed threads such that the malleable washer 312 and nut 310 will not loosen and fall off the steel shaft. Nut 410 is tightened such that tension is created along the steel shaft 314 between nuts 410 and 310. The threaded steel shaft interior to the house that is inserted through the roof may be shortened if necessary by sawing off a portion of the threaded steel shaft 314. Referring to FIG. 4C, nut 311B is threaded onto the steel shaft 314 and then washer 313B is slid onto the threaded steel shaft as well. Next, bracket 316 is inserted over the steel shaft through hole 315. Bracket 316 is then bolted to either a rafter or joist 422 of the house by use of nut/bolt assemblies 319A and 319B. FIG. 3E, described above, illustrates the nut/bolt assembly 319A in detail and how bracket 316 is similarly held against the rafter or joist 422. Referring to FIG. 4C, steel washer 313 is then inserted over the threaded steel shaft 314 and nut 311 is then threaded onto the steel shaft. Nuts 311 and 311B are tightened against the bracket 316 in order to create tension in the steel shaft 314 and hold the chimney 112F to the house.

After the steel rebar 100 and the two chimney anchors are installed, another inspection is made by the city building commissioner of the installation. Measurements are actually taken to be sure that the installation of the horizontal and vertical reinforcement are made according to the engineering specifications.

After receiving approval of the installation, a reinforcing compound such as polymer concrete 302 is then poured into the space 103. If the polymer concrete 302 oozes out through the joints of the brick it is sponged off the brick masonry unit. If it oozes out through the joints or cracks of the chimney liner 104 then it is wiped smooth to the surface of the chimney liner. The polymer concrete 302 is allowed time to cure and then the bond beam 108 is installed around the steel rebar 100. Mortar cement is then used to pour the mortar cap 114 and it is allowed to cure. Next the spark arrestor 116 is installed to complete the assembly of the retrofitted chimney 112E or 112F. Flashing may be added around the holes in the roof 420 in the case of the exterior roof chimneys. The exterior nuts 310, 410 and malleable washers 312, 412 may be painted with a rust proof paint such as Rustolium for aesthetic reasons.

While a preferred embodiment of the present invention has been disclosed and described in detail herein, it will be obvious to those skilled in the art that various changes in form and detail may be made therein without departing from the spirit and scope thereof.

What is claimed is:

1. A method for seismically reinforcing a pre-existing brick chimney, the steps comprising:

(a) drilling two horizontal holes extending through a width of said pre-existing brick chimney;

(b) inserting vertical steel rebar extending approximately the length of said pre-existing brick chimney;

(c) inserting a threaded shaft, having a first end and a second end with a washer coupled to said first end of said threaded shaft, into one of said two horizontal holes extending through the width of said pre-existing brick chimney;

(d) coupling a bracket to said second end of said threaded shaft;

(e) coupling said bracket to either a house joist or a house rafter; and (f) coupling a nut to said second end of said threaded shaft to create tension along said threaded shaft between said pre-existing brick chimney and said house joist or house rafter.

2. The method of claim 1 for seismically reinforcing a pre-existing brick chimney, the steps further comprising:

repeating steps (c) through (f).

3. The method of claim 1 for seismically reinforcing a pre-existing brick chimney, the steps further comprising:

inserting a chimney liner into the center portion of said pre-existing brick chimney if none is present.

4. The method of claim 2 for seismically reinforcing a pre-existing brick chimney, the steps further comprising:

pouring a reinforcing compound between said pre-existing brick chimney and said chimney liner to couple said pre-existing brick chimney, said chimney liner, said threaded shaft, and said vertical reinforcement shafts and to reinforce said pre-existing brick chimney.

* * * * *

UNITED STATES PATENT AND TRADEMARK OFFICE

CERTIFICATE OF CORRECTION

PATENT NO. : 6,199,345 B1
DATED : March 13, 2001
INVENTOR(S) : Dean

It is certified that error appears in the above-identified patent and that said Letters Patent is hereby corrected as shown below:

Title page,
Field number 76, please delete "37 Avondale Ave" and insert -- 27 Avondale Ave --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*